US007066798B2

(12) United States Patent
Choi

(10) Patent No.: US 7,066,798 B2
(45) Date of Patent: Jun. 27, 2006

(54) ADAPTER FOR GRINDING MACHINE

(75) Inventor: Keun Seok Choi, Shihung-si (KR)

(73) Assignee: Dongsin Diaflx Co., Ltd. (KR)

( * ) Notice: Subject to any disclaimer, the term of this patent is extended or adjusted under 35 U.S.C. 154(b) by 890 days.

(21) Appl. No.: 09/871,331

(22) Filed: May 30, 2001

(65) Prior Publication Data

US 2002/0052178 A1 May 2, 2002

(30) Foreign Application Priority Data

Oct. 31, 2000 (KR) ..... 2000-30423

(51) Int. Cl.
*B24B 19/00* (2006.01)

(52) U.S. Cl. ..... 451/425; 451/120; 451/124; 451/415

(58) Field of Classification Search ..... 451/450, 451/120, 124, 415, 425, 508, 442
See application file for complete search history.

(56) References Cited

U.S. PATENT DOCUMENTS 3,312,118 A * 4/1967 Aubert ..... 74/424.95
5,305,556 A * 4/1994 Kopp et al. ..... 451/165
5,498,198 A * 3/1996 Kogure ..... 451/146
5,649,852 A * 7/1997 Zepp ..... 451/157
6,129,619 A * 10/2000 Bergqvist ..... 451/450

* cited by examiner

*Primary Examiner*—Eileen P. Morgan
(74) *Attorney, Agent, or Firm*—Roth & Goldman, P.A.

(57) ABSTRACT

Disclosed is an adapter for grinding machine comprising: a grinding shaft sleeve of cylindrical shape whose one end is open and having at least one through hole formed at a selected position of an outer circumference; a grinding shaft rotatably and movably fitted in the grinding shaft sleeve, the grinding shaft including at least one guide groove having a variable surface curvature with respect to a shaft direction and formed at a position corresponding to the through hole, the grinding roller being installed at one end of the grinding shaft and a rotational force generating unit being installed at the other end of the grinding shaft; a grinding shaft stroke unit whose one end is coupled to the through hole of the grinding shaft sleeve and the other end is fitted in the guide groove, for stroking the grinding shaft with the grinding shaft sleeve; a sealing means interposed between an outer circumference of the grinding shaft and the grinding shaft sleeve, for preventing leakage of oil; and a sealing cover coupled to the grinding shaft stroke unit, for sealing the grinding shaft stroke unit.

7 Claims, 6 Drawing Sheets

ADAPTER FOR GRINDING MACHINE

BACKGROUND OF THE INVENTION

The present invention relates to an adapter for a grinding machine, and more particularly, to an adapter for a grinding machine which allows a grinding direction of a rotatable grinding roller to be directed toward a first direction and a second direction different from the first direction with respect to a grinding surface of a workpiece to be ground, thereby preventing occurrence of stripe in the ground surface and local abrasion of the rotatable roller.

DESCRIPTION OF THE RELATED ART

Stones such as granite and marble are generally used as interior and exterior decoration material for various architectures, or living necessaries. These stones (or workpieces) are cut into boards if necessary. The cut boards are then ground to obtain a smooth and glossy surface. Thus, in order to obtain a smooth and glossy surface of stones, it is necessary to use grinding machines.

Generally, grinding machines are widely being used in various appliances as a processing apparatus for the surface processing and precision dimension processing of workpieces such as general metals, noble metals, and jewels as well as the aforementioned stones.

Thus, the grinding machines rotates the grinding roller having a cylindrical shape using a rotational force which is generated by the rotational force generating unit along the rotational force direction of the rotational force generating unit and contacts the rotating grinding roller to a surface of a workpieces so that the workpiece obtains a smooth and glossy surface.

Then, the aforementioned conventional grinding machines rotates the grinding roller along one direction only, that is, the rotational force direction, using the rotational force generated by the rotational force generating unit to grind the surface of the workpiece.

To this end, the grinding roller is locally abraded at a side portion thereof, thereby shortening the life of the grinding roller.

Also, stripe is generated on the ground surface of the workpiece along the rotational direction of the grinding roller, thereby there occurs a failure of surface processing in that uneven surface is obtained.

Furthermore, the grinding roller is made integrally with the rotational force generating unit, which makes it difficult to exchange the grinding roller with a new one and increases endeavors and times due to such a frequent exchange of the grinding roller, thereby not only delaying the grinding processing time but shortening the life of the grinding machine.

Therefore, it is requested to provide an improved grinding machine having an adapter capable of resolving the aforementioned problems, easily exchanging the grinding roller, obtaining evenly processed surface, and making it easy to perform the grinding works.

SUMMARY OF THE INVENTION

Accordingly, it is one object of the present invention to prevent the grinding roller from being locally abraded.

It is another object of the invention to prevent a surface processing failure such as occurrence of stripe on the ground surface of a workpiece due to the simplicity in the rotational direction of the grinding roller.

It is still another object of the invention to allow the grinding roller to be easily separated from or assembled to the rotational force generating unit by making it possible to exchange the adapter only.

To accomplish these advantages and objects, there is provided an adapter for a grinding machine comprising: a grinding shaft sleeve of a cylindrical shape whose one end is open and having at least one through hole formed at a selected position of an outer circumference; a grinding shaft rotatably and movably fitted in the grinding shaft sleeve, the grinding shaft including at least one guide groove having a variable surface curvature with respect to a shaft direction and formed at a position corresponding to the through hole, the grinding roller being installed at one end of the grinding shaft and a rotational force generating unit being installed at the other end of the grinding shaft; a grinding shaft stroke unit whose one end is coupled to the through hole of the grinding shaft sleeve and the other end is fitted in the guide groove, for stroking the grinding shaft with the grinding shaft sleeve; a sealing means interposed between an outer circumference of the grinding shaft and the grinding shaft sleeve, for preventing leakage of oil; and a sealing cover coupled to the grinding shaft stroke unit, for sealing the grinding shaft stroke unit.

Selectively, the grinding shaft stroke unit comprises: a bearing fixing screw whose one end is screwed to the through hole of the grinding shaft sleeve and the other end has a bearing shaft; and a bearing inserted into the bearing shaft when the bearing fixing screw is coupled to the grinding shaft sleeve and rotated within the guide groove of the grinding shaft.

Selectively, the grinding shaft sleeve comprises a first through hole and a second through hole corresponding to the first through hole such that a height difference exists between the first through hole and the second through hole.

Selectively, the grinding shaft comprises: a first guide groove formed at an outer circumference thereof, corresponding to the first through hole of the grinding shaft sleeve and having a first surface curvature varied with respect to the shaft direction; and a second guide groove spaced apart by a constant interval, corresponding to the second through hole of the grinding shaft sleeve and having a second surface curvature which is the same with that of the first guide groove with respect to the shaft direction.

Preferably, the first surface curvature of the first guide groove has an opposite direction to the second curvature of the second guide groove.

Preferably, when a variation in the first surface curvature with respect to the shaft direction is defined as R1 and a variation in the second curvature with respect to the shaft direction is defined as R2, R1 is 70 and R2 is 57.1 when the grinding shaft is placed at a rotation angle of 180 degrees and R1 and R2 are 57.8 when the grinding shaft is placed at a rotation angle of 360 degrees.

Preferably, the guide groove comprises at lease one cam groove.

With the aforementioned constitution, the grinding shaft of the adapter ascends and descends along the grinding shaft stroke unit with varying the rotational force depending on a degree of contact force between the grinding roller and the workpiece, thereby enabling the workpiece to obtain a smooth and glossy surface.

BRIEF DESCRIPTION OF THE DRAWINGS

The above object and other advantages of the present invention will become more apparently by describing in detail the preferred embodiments thereof with reference to the accompanying drawing, in which.

DETAILED DESCRIPTION OF THE PREFERRED EMBODIMENTS

Figure 1:
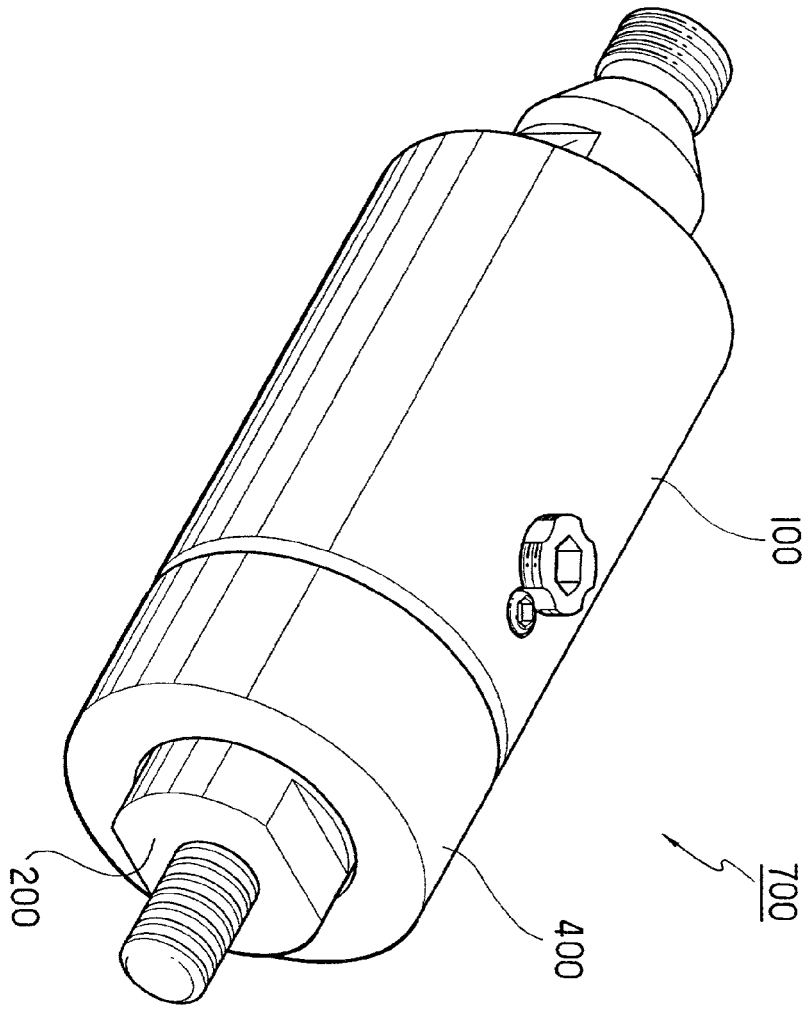
FIG. 1 is a perspective view of an adapter for a grinding machine in accordance with a preferred embodiment of the present invention.

Hereinafter, there is described an adapter for a grinding machine in accordance with preferred embodiments of the present invention with reference to the accompanying drawings.

A grinding machine of the invention comprises a rotational force generating unit (not shown in the drawings), an adapter and a grinding roller (not shown) installed in the adapter, for performing a grinding.

The rotational force generating unit includes all means for generating the rotational force necessary for the grinding. The grinding roller is not limited to a specific constitution and shape if it is possible to perform the grinding.

Hereinbelow, there is described the adapter which is a key element of the invention with reference to the accompanying drawings.

Figure 2:
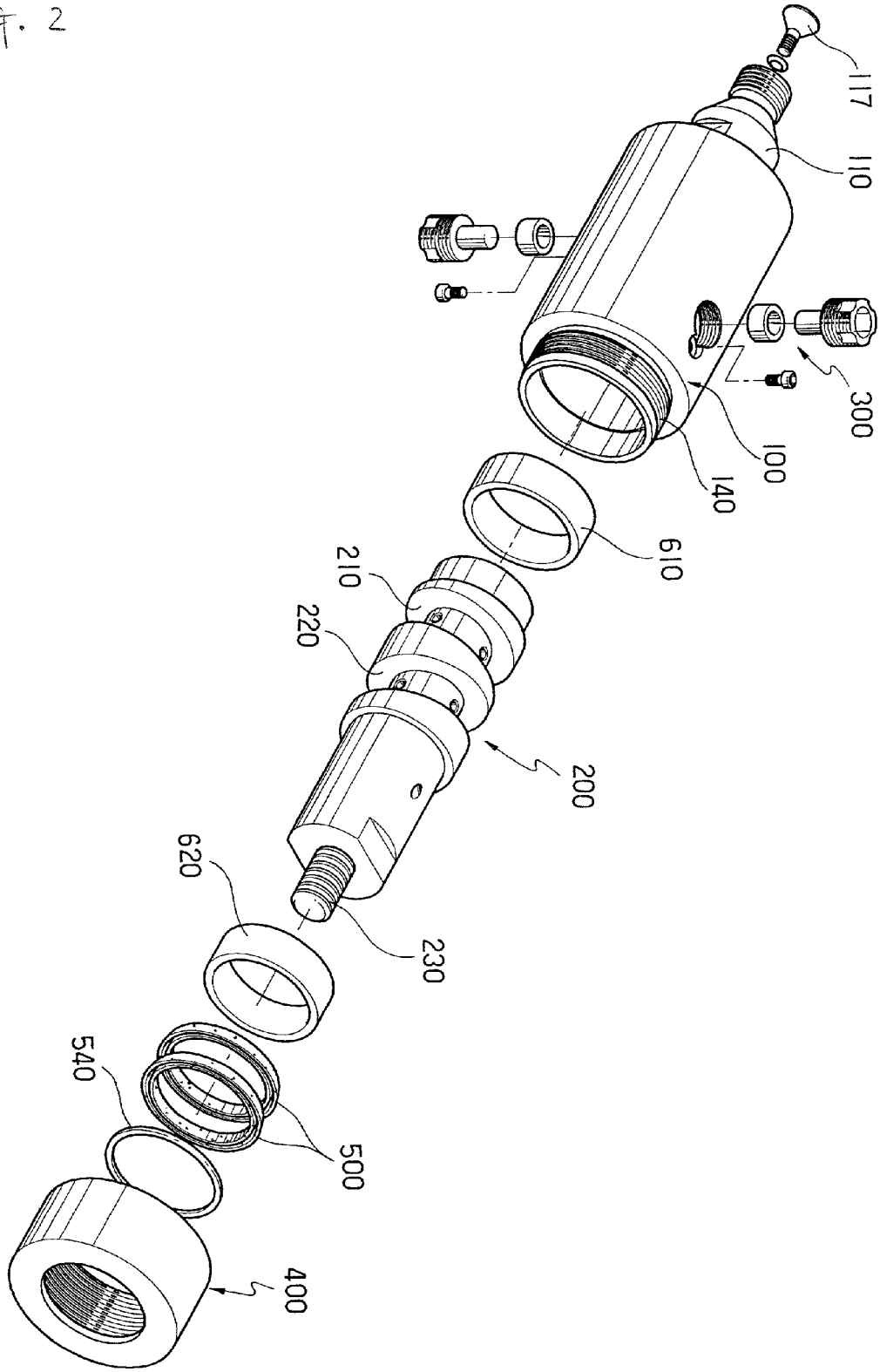
FIG. 2 is an exploded perspective view of an adapter for a grinding machine in accordance with a preferred embodiment of the present invention.
Figure 3:
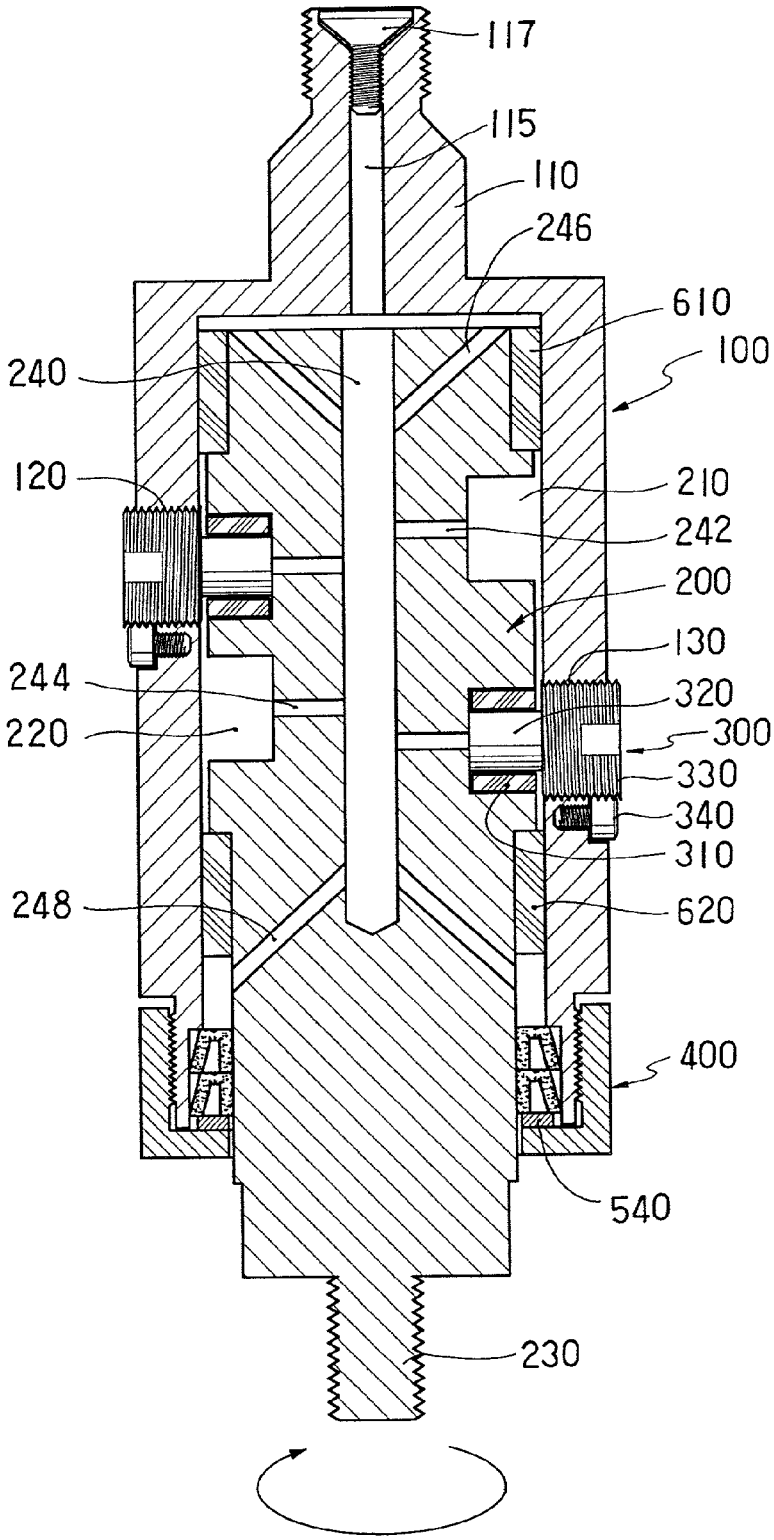
FIG. 3 is a sectional view of an adapter for a grinding machine in accordance with a preferred embodiment of the present invention.

FIG. 1 is a perspective view of the adapter for a grinding machine, FIG. 2 is an exploded perspective view of the adapter, and FIG. 3 is a sectional view of the adapter.

Referring to FIG. 1 to FIG. 3, an adapter 700 includes a grinding shaft sleeve 100, a grinding shaft 200, a grinding shaft stroke unit 300, an oil sealing cover 400, and a sealing member 500.

Specifically, the grinding shaft sleeve 100 has a cylindrical shape whose one end is closed.

More specifically, at the closed end of the grinding shaft sleeve 100, a rotational shaft installing protrusion 110 is formed to be coupled to the rotational shaft of the rotational force generating unit. At the center of the rotational shaft installing protrusion 110, an oil introducing through hole 115 is formed to communicate the rotational shaft installing protrusion 110 with the inside of the grinding shaft sleeve 100.

Nondescribed numeral 117 is a sealing cover for sealing the oil introducing through hole.

In the meanwhile, at a predetermined position on the outer circumference of the grinding shaft sleeve 100, that is, the upper side of the center, there is formed a first through hole 120 penetrating the outer circumference of the grinding shaft sleeve 100. At an opposite side to the first through hole 120, there is formed a second through hole 130. The second through hole 130 is placed below the first through hole 120 and has a height difference than the first through hole 120. At this time, at the inner circumference of the first and second through holes 120 and 130, a female screw part is commonly formed.

Also, at the outer circumference of the first and second through holes 120 and 130 corresponding to an opened end portion of the grinding shaft sleeve 100, a male screw part 140 is formed. The male screw part 140 is coupled to an oil sealing cover 400 to be described later.

The grinding shaft 200 is inserted into and is coupled to an inner space of the grinding shaft sleeve 100.

The grinding shaft 200 has an inner diameter slightly less than an inner diameter of the grinding shaft sleeve 100, which minimizes the abrasion resistance caused by the contact with the inner circumference of the grinding shaft sleeve 100 when the grinding shaft 200 is rotated, ascended, or descended.

Then, in case that the diameter of the grinding shaft 200 is less than the diameter of the inner circumference of the grinding shaft sleeve 100 and the grinding shaft 200 is rotated, ascended, or descended inside the grinding shaft sleeve 100, severe swaying and vibration are generated. To this end, to prevent the occurrence of the swaying and vibration with a minimum abrasive force even when the grinding shaft 200 is rotated inside the grinding shaft sleeve 100, a pair of bushings 610 and 620 are installed at both ends of the grinding shaft 200.

In the meanwhile, at the outer circumference of the grinding shaft 200, there are formed two guide grooves consisting of a first guide groove 210 and a second guide groove 220 each having a predetermined depth along the outer circumference of the grinding shaft 200.

The first guide groove 210 and the second guide groove 220 have respective slopes with respect to the horizontal plane. In other words, the first guide groove 210 has a first slope corresponding to a first surface curvature with respect to the shaft direction. The first through hole 120 is positioned at a selected position of the trace of the first guide groove 210.

In the meanwhile, the second guide groove 220 has a second slope which is symmetric with the first guide groove 210. In other words, the second slope is the same with that of the first guide groove 210 and its slope direction is opposite to that of the first guide groove 210. The second through hole 130 is positioned at a selected position of the trace of the second guide groove 220.

The grinding shaft stroke unit 300 is installed at the first and second guide grooves 210 and 220 through the first and second through holes 120 and 130.

Here, when the first slope of the first guide groove 210 with respect to the shaft direction of the grinding shaft 200, i.e., a variation of the first surface curvature is assumed to be R1, and the second slope of the second guide groove 220, i.e., a variation of the second surface curvature is assumed to be R2, R1 is 50 and R2 is 57.1 at an angle of 180 degrees of the grinding shaft 200 and R1 and R2 are both 57.8 at an angle of 360 degrees of the grinding shaft 200.

The grinding shaft stroke unit 300 includes an oil-containing bearing 310 and a fixing screw 30 having a male screw formed at the outer circumference of a screw head which is installed at one end of the bearing shaft 320 into which an inner circumference of the oil-containing bearing 310 is inserted.

Thus, in such a state the oil-containing bearing 310 is inserted into the bearing shaft 320 and the bearing fixing screw 330 is inserted into the first and second guide grooves 210 and 220 through the first through hole 120 and the second through hole 130, the male screw part of the bearing fixing screw 330 is coupled to the female screw part of the first and second through holes 120 and 130.

Here, nondescribed numeral 340 is a releasing preventive screw for preventing the bearing fixing screw 330 from being released.

At this time, in such a state the grinding shaft 200 is coupled to the grinding shaft sleeve 100 by using the grinding shaft stroke unit 300 such that the grinding shaft 200 is rotated, ascended or descended, oil, for example, grease should be supplied at a contact portion between the grinding shaft sleeve 100 and the grinding shaft 200 so as to decrease the abrasive force between the grinding shaft 200 and the grinding shaft sleeve 100 to a large degree.

To realize this, an oil injection groove 240 having a predetermined depth is formed at the end portion facing with a rotational shaft installing protrusion 110 of the grinding shaft sleeve 100 in the grinding shaft 200 such that the oil injection groove 240 faces with the oil introducing through hole 115. Oil injection grooves 242 and 244 are formed at the first and second guide grooves 242 and 244 such that they communicate with the oil injection groove 240.

Thus, in order to decrease the abrasion between the grinding shaft sleeve 100 and the grinding shaft 200, remove the unstability in rotation, and prevent injected oil from flowing out, an oil sealing cover 400 and a sealing member 500 are formed at the male screw part 140 disposed at one end of the outer circumference of the grinding shaft sleeve 100.

The sealing member 500 has a ring shape whose sectional face is V-shape and is inserted into the inner circumference of the grinding shaft sleeve 100.

To insert the sealing number 500 at a directed position of the inner circumference of the grinding shaft sleeve 100, a jaw is preferably formed at the inner circumference of the grinding shaft sleeve 100. Nondescribed numeral 540 is washer.

In such the aforementioned state, the female screw part formed at the inner circumference of the oil sealing cover 400 having a cap shape is coupled to the male screw part 140 formed at the outer circumference of the grinding shaft sleeve 100.

Hereinbelow, an assembly procedure of the adaptor 700 for the grinding machine is described.

In such a state two bushings 610 and 620 and the sealing member 500 are inserted into the directed position of the grinding shaft 200, the grinding shaft 200 is inserted into the grinding shaft sleeve 100. In such the aforementioned state, the grinding shaft stroke unit 300 is assembled at the first guide groove 210 and the second guide groove 220. Thereafter, the oil sealing cover 400 is assembled at the grinding shaft sleeve 100.

Afterwards, the rotational shaft of the rotational force generating unit is assembled at the rotational shaft installing protrusion 110 formed at the grinding shaft sleeve 100. The grinding roller is installed at the grinding shaft installing protrusion 230 formed at the grinding shaft 200.

Next, an operation of the grinding machine having the aforementioned adapter is described with reference to the accompanying drawings of FIG. 4 to FIG. 6.

Figure 4:
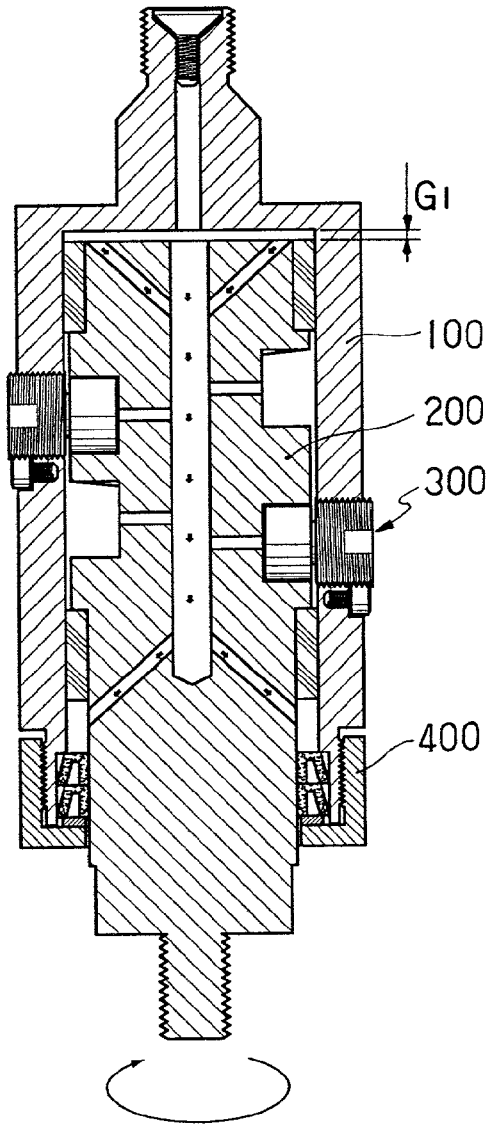
FIG. 4 is a sectional view of an adapter for a grinding machine when the adapter is placed at an initial state.
Figure 5:
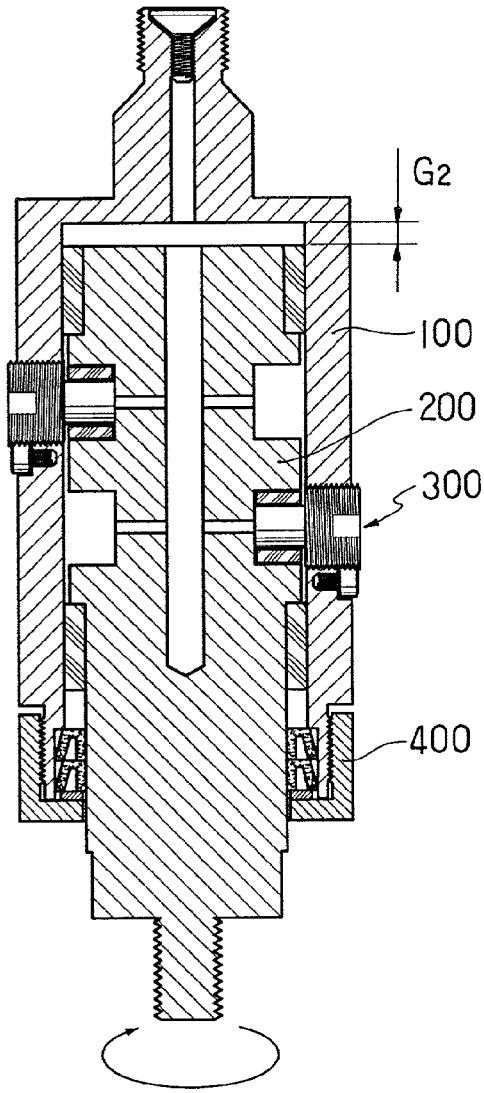
FIG. 5 is a sectional view of an adapter for a grinding machine when the adapter is rotated by 90 degrees.
Figure 6:
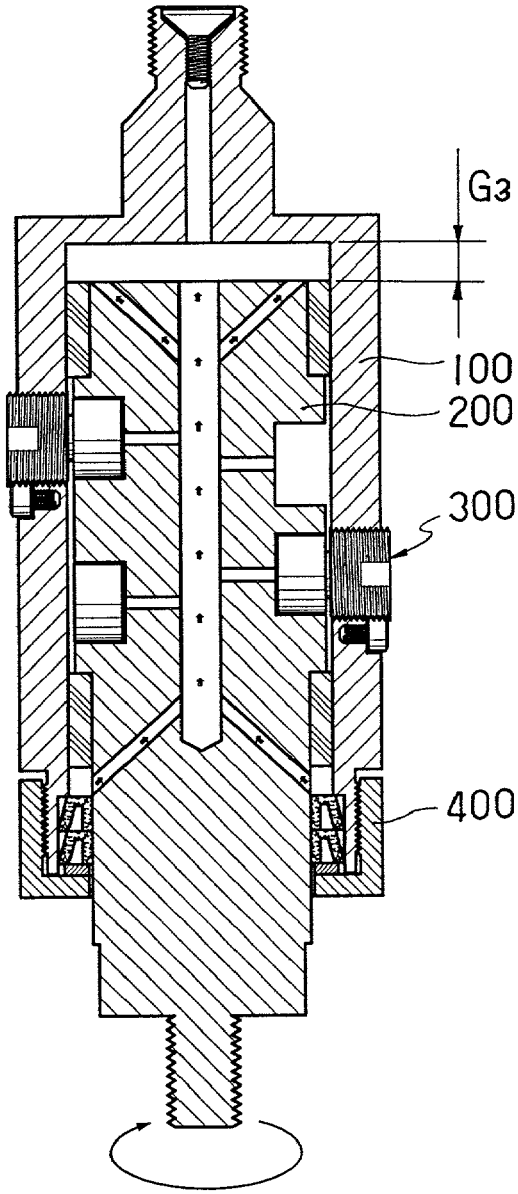
FIG. 6 is a sectional view of an adapter for a grinding machine when the adapter is rotated by 180 degrees.

FIG. 4 shows that the grinding machine is in an initial state, i.e., zero degree, FIG. 5 shows a state of when the grinding machine is rotated by 90 degrees; and FIG. 6 shows a state of when the grinding machine is rotated by 180 degrees.

As shown in FIG. 4, in a case that the grinding roller (not shown) is not contact with a workpiece to be ground, any external force is not applied between the grinding shaft 200 and the grinding shaft sleeve 100. So, the grinding shaft 200 and the grinding shaft sleeve 100 are rotated at the same velocity.

However, as the grinding roller is in contact with the workpiece to be ground, the grinding shaft sleeve 100 is still rotated by the rotational force generated by the rotational force generating unit while the grinding shaft 200 is rubbed with the grinding roller and the workpiece, thereby the rotational force of the grinding shaft 200 decreases depending on the rubbed degree.

Like this, depending on the difference in the rotational force between the grinding shaft 200 and the grinding shaft sleeve 100, the rotational velocity of the grinding shaft 200 decreases compared with that of the grinding shaft sleeve 100, thereby rotational slip occurs between the grinding shaft 200 and the grinding shaft sleeve 100.

In case the aforementioned rotational slip occurs, another rotational force is generated at the inside of the grinding shaft sleeve 100 as shown in FIG. 5, and the grinding shaft 200 starts to rotate and be transferred downward along the first and second guide grooves 210 and 220.

Referring to FIG. 6, when the grinding shaft 200 is rotated by an angle of approximately 180 degrees, the grinding shaft 200 descends to the lowest position.

Such facts can be confirmed comparing the intervals G1, G2, G3 between the grinding shaft sleeve 100 and the grinding shaft 200 in FIG. 4 to FIG. 6. These intervals has a relation of G1<G2<G3.

Thereafter, the grinding shaft 200 is further rotated by angles of 90 degrees and 180 degrees and thereby the grinding shaft 200 returns to the original position from the descended position.

Thus, the stroke of the grinding shaft 200 becomes faster depending on a pressured degree of the workpiece, i.e., as the pressure of the grinding roller pressing the workpiece increases. As a result, the grinding roller rubs the workpiece not only along the rotational direction of the grinding shaft sleeve 100 but along the stroke direction of the grinding shaft 200, Thereby, local abrasion of the grinding roller and occurrence of stripes in the surface of the workpiece are prevented.

Another embodiment of the present invention is forming at least one cam groove at the first and second grooves 210 and 220 formed at the grinding shaft 200. The cam groove changes the motion of the stroke of the grinding shaft 200, thereby enabling the grinding machine of the present invention to perform more effective grinding.

As described previously, comparing with the conventional art in which a workpiece is processed only along one rotational direction of the grinding roller, that is, the direction of the rotational force generated by the rotational force generating unit, the present invention differs from the conventional art in that the grinding shaft of the adapter for grinding machine can be rotated along an opposite direction with ascending or descending depending on a degree of contact force between the grinding roller and the workpiece.

As a result, local abrasion of the grinding roller is prevented and the occurrence of the strips due to the grinding along only one direction is also prevented.

Further, the present invention substantially decreases endeavor and time spent in the surface grinding, thereby enhancing productivity and yield.

Moreover, since the adapter is separated from the grinding machine, life of the grinding machine becomes longer and repair of the machine becomes easier.

While the present invention has been described in detail with reference to the preferred embodiments, those skilled in the art will appreciate that various modifications and substitutions can be made thereto without departing from the spirit and scope of the present invention as set forth in the appended claims.

The invention claimed is:

1. An adapter for coupling a source of rotary power to a grinding roller, the adapter comprising:

a grinding shaft sleeve of a cylindrical shape having one open end and another end for coupling to a rotary shaft of a power unit, and having at least one through hole formed at a selected position on an outer circumferential surface thereof;

a stroke shaft received in said open end of the grinding shaft sleeve, for reciprocating and rotational movement with respect to said grinding shaft sleeve, said stroke shaft including at least one guide groove having a surface curvature which varies with respect to a shaft direction, the stroke shaft formed at a position corresponding to the through hole of the grinding shaft sleeve, and the stroke shaft having one end separably coupled with a drum-shaped grinding roller;

a stroke generating unit affixed to said grinding shaft sleeve, said stroke generating unit including a bearing fitted into the guide groove through the through hole of the grinding shaft sleeve such that, when the grinding shaft sleeve is rotated, said bearing moves along the guide groove while allowing the stroke shaft to reciprocate and rotate with respect to the grinding shaft sleeve;

a sealing means interposed between stroke shaft and the grinding shaft sleeve, for preventing leakage of oil; and a sealing cover for sealing an oil passage which extends through the grinding shaft and the closed end of of the stroke shaft.

2. The adapter of claim 1, wherein the stroke generating unit comprises:

a shaft protruding from one end of a male threaded part of the bearing and fitted into the guide groove of the stroke shaft and a bearing rotatably mounted on the bearing shaft.

3. The adapter of claim 1, wherein said grinding shaft sleeve comprises a first through-hole and a second through-hole corresponding to the first through-hole at axially spaced positions on opposite sides of said grinding shaft sleeve.

4. The adapter of claim 1, wherein said stroke shaft comprises:

a first guide groove formed at an outer circumference thereof, and facing the first through-hole and having a first surface curvature varied with respect to the shaft direction; and a second guide groove facing the second through hole and having a second surface curvature which is the same with that of the first guide groove with respect to the shaft direction.

5. The adapter of claim 4, wherein the first surface curvature of the first guide groove is in an opposite direction to the second curvature of the second guide groove.

6. The adapter of claim 5, wherein, when a variation in the first surface curvature with respect to the shaft direction is defined as R1 and a variation in the second curvature with respect to the shaft direction is defined as R2, R1 is 70 and R2 is 57.1 when the grinding shaft is placed at a rotation angle of 180 degrees and R1 and R2 are 57.8 when the grinding shaft is placed at a rotation angle of 360 degrees.

7. The adapter of claim 1, wherein the guide groove comprises at least one oil introducing through-hole.

* * * * *